United States Patent [19]

Baker

[11] Patent Number: 4,670,822

[45] Date of Patent: Jun. 2, 1987

[54] LIGHT ASSEMBLY

[75] Inventor: Philip A. Baker, Solihull, England

[73] Assignee: Lucas Industries Public Limited Company, Birmingham, England

[21] Appl. No.: 670,024

[22] Filed: Nov. 9, 1984

[30] Foreign Application Priority Data

Nov. 19, 1983 [GB] United Kingdom ..... 8330925

[51] Int. Cl.[4] ..... H01R 33/00

[52] U.S. Cl. ..... 362/226; 362/61; 362/294; 362/365

[58] Field of Search ..... 362/61, 226, 294, 365, 362/296, 435, 436, 437, 438

[56] References Cited

U.S. PATENT DOCUMENTS

| | | | |
|---|---|---|---|
| 2,233,486 | 3/1941 | Portnow | 362/226 |
| 3,486,019 | 12/1969 | Bryant | 362/294 |
| 4,219,870 | 8/1980 | Haraden | 362/226 |
| 4,390,931 | 6/1983 | Gorick | 362/226 |
| 4,500,946 | 2/1985 | Mikola | 362/226 |
| 4,507,712 | 3/1985 | Dolan | 362/226 |

FOREIGN PATENT DOCUMENTS

| | | | |
|---|---|---|---|
| 1902362 | 9/1969 | Fed. Rep. of Germany | 362/61 |
| 1764228 | 3/1972 | Fed. Rep. of Germany | 362/61 |
| 1196393 | 6/1970 | United Kingdom | 362/365 |
| 1407024 | 9/1975 | United Kingdom | 362/61 |
| 2029953 | 3/1980 | United Kingdom | 362/61 |

*Primary Examiner*—Ronald B. Cox

[57] ABSTRACT

To retain a lamp in a reflector body of a light assembly, a wire retaining clip is provided which has a U-shaped anchor portion disposed as a friction fit in a recess in the body. Arms of the clip extend in cantilever fashion from the anchor portion and engage against a flange on the lamp so as to urge an abutment surface on the lamp into engagement with a corresponding abutment surface in the reflector body. The arms of the clip are resiliently biassed in the same direction as that required to bring said abutment surfaces into mutual engagement and are also resiliently deformable outwardly so as to facilitate snap-engagement of the lamp into a lamp-receiving aperture in the reflector body.

12 Claims, 15 Drawing Figures

LIGHT ASSEMBLY

Figure 1:
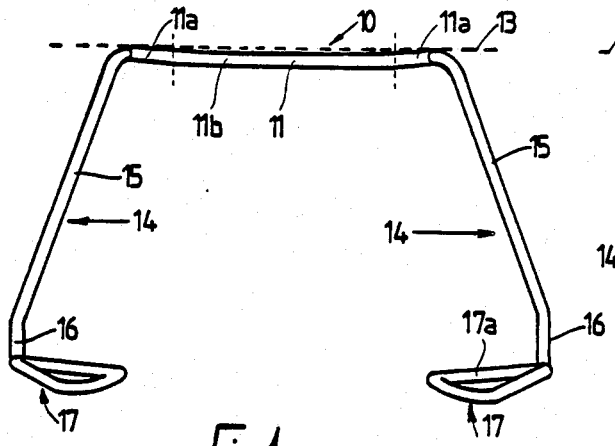

This invention relates to a light assembly provided with a retaining device for retaining a lamp in a lamp receiving aperture in a reflector body, of the light assembly with respective abutment surfaces on the body and the lamp in mutual engagement.

In the mass production of light assemblies, it is known to manufacture light reflector bodies by a moulding process using a synthetic plastics material. It has been previously proposed to use a retaining device in the form of a pair of spring clips to retain the lamp in a lamp-receiving aperture in the reflector body with respective abutment surfaces on the reflector body and on the lamp being in mutual engagement. However, formations are required on the reflector body to enable attachment of the spring clips thereto. In one previous proposal, the reflector body is moulded with four flanges thereon around the lamp-receiving aperture. The flanges are subsequently drilled to receive the ends the of spring clips. However, such a technique involves the extra step of accurately drilling the flanges at the required location.

In another proposal, the reflector body is provided with an undercut recess therein into which a hinge portion of a clip having two arms is inserted and then retained in position by a plate which is fastened to the body so as to extend over the opening of the recess. To secure the lamp in position, the arms of the clip are latched into respective undercut recesses in the body. However, such a procedure involves the extra steps and expense of forming the undercut recesses and securing a separate part to the body to retain the clip in position.

Additionally, the above-mentioned previous proposals do not easily lend themselves to mass production techniques in moulding the reflector body and in assembling the lamp into the reflector body and securing it in position.

It has also been previously proposed in GB-A No. 1231463 to provide a headlight assembly in which the lamp is retained in position by resilient locking means which include projections urged towards the axis of a tubular member surrounding a lamp-receiving opening in the reflector. The projections include and/or bear against surfaces which are inclined with respect to the axis of the tubular member such that the inward force on the projections causes the lamp to be resiliently retained in position in the opening. The resilient locking means is such that deflection of the projections away from the axis of the tubular member enables axial withdrawal of the lamp from the tubular member.

Such an arrangement of locking device requires the provision of apertures through the side wall of the tubular member for passage of the projections of the resilient locking means and also relies on the radially inward force developed by the locking means to produce, via the inclined surfaces, the necessary forces to hold the lamp in position in the opening. Necessarily, such an arrangement is relatively complicated and firm retention of the lamp in position is difficult to achieve.

It is an object of the present invention to provide an improved form of light assembly which can enable the above mentioned problems to be obviated or mitigated.

According to the present invention, there is provided a light assembly comprising a reflector body having a lamp-receiving aperture and an abutment surface, and a retaining device for urging in a first direction an abutment surface on a lamp against said abutment surface on the body, said device including a resilient element having an anchor portion non-pivotally secured to the body, and at least one arm portion extending in cantilever fashion and which is resiliently biassed in said first direction against the lamp in use so as to urge resiliently the abutment surfaces of the body and the lamp into mutual engagement.

Preferably, said lamp-receiving aperture is defined by a sleeve extending in said first direction from said body, and said at least one arm portion extends in use from said anchor portion over a free end of said sleeve within said aperture.

Preferably, the arrangement is such that bearing of said at least one arm portion against the lamp in use causes said anchor portion to be deformed, thereby increasing the force required to disengage the anchor portion from the body, the anchor portion being engageable with said body when said at least one arm portion is not in a stressed condition by virtue of being resiliently biassed against the lamp.

In a particularly preferred embodiment of lamp assembly, said anchor portion defines a projection for engagement in a recess in said body. It will be appreciated that, because of the locking action obtained by deformation of the anchor portion, the recess can be formed so as to extend in the direction of draw of said body from the mould in the case where the component is formed by a moulding operation. Alternatively, the anchor portion of the resilient element may have an aperture for engagement over a post on said body. In such an embodiment, the anchor portion having the aperture is deformed upon deformation of said at least one arm portion when the post extends through the aperture, thus causing the anchor portion to lock against the post.

Preferably, the resilient element is in the form of a wire clip.

In the embodiment where the anchor portion is engageable in a recess in the body, it is preferred for said portion to take the form of a substantially U-shaped portion and for the recess to have a width and thickness which corresponds to the width and thickness of the U-shaped portion.

In a preferred embodiment, the resilient element has a pair of spaced arms extending from said anchor portion. Preferably, the arm portions and the anchor portion are of one-piece construction.

In a preferred embodiment, the construction is such that said at least one arm portion is resiliently biassed into engagement with said first abutment surface when the lamp is not assembled in the body. With such an arrangement, stressing of said at least one arm portion causes said anchor portion to be secured to the body so that the retaining device does not become inadvertently disengaged from the body during assembly of the lamp into the body.

With some lamp reflector bodies, the body is provided with a protection coating of lacquer thereon. With such bodies, it is preferred to apply the lacquer coating after engagement of the retaining device with the body so that, after drying the lacquer over the anchor portion assists in ensuring that the device does not become accidently disengaged from the body.

In another preferred embodiment said at least one arm portion is also resiliently deformable in a second direction which is substantially perpendicular to said first direction, to a position in which it lies clear of said lamp.

With such a construction of resilient element, it is possible to deform said at least one arm portion in said second direction so as to lie clear of the lamp which can then be removed and, provided that the lamp body is suitably configurated, said at least one arm portion can then be allowed to move in said first direction under its own resilient biassing to engage with the body at a location which is beyond said abutment surface of the body in said first direction. By this means, it is possible to ensure that said at least one arm portion is releasably retained in a position in which it lies clear of the lamp so that the latter can be freely engaged with and disengaged from the first component.

In order to mitigate the possibility of damage to the retaining device in the event of an attempt to withdraw the lamp forcibly without first moving said at least one arm portion out of the way, interlocking formations may be provided on the arm portion and the body to resist deformation of the arm portion. Alternatively, the arm portion may be provided with a part which engages said lamp in use and is inclined with respect to said first direction so that, when an attempt is made to withdraw the lamp forcibly in a direction opposite to said first direction, said arm portion is moved thereby in said second direction i.e in a direction which is transverse to said first direction.

Figure 2:
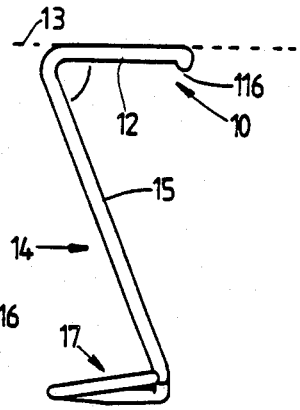
Figure 3:
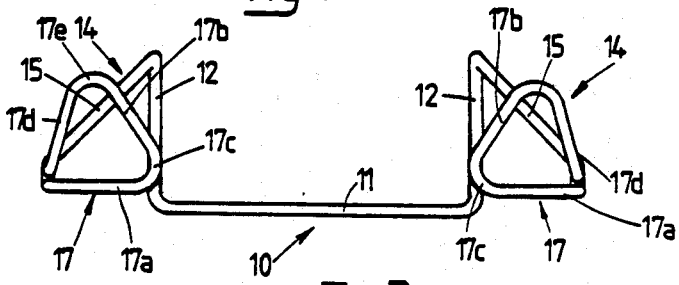
Figure 4:
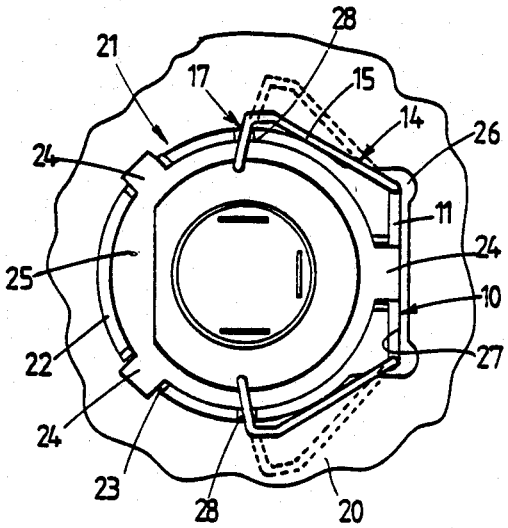
Figure 5:
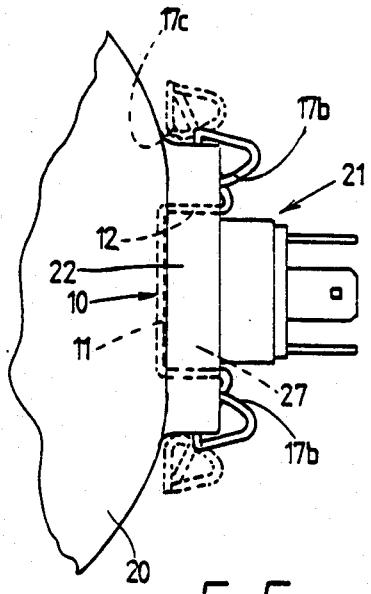
Figure 6:
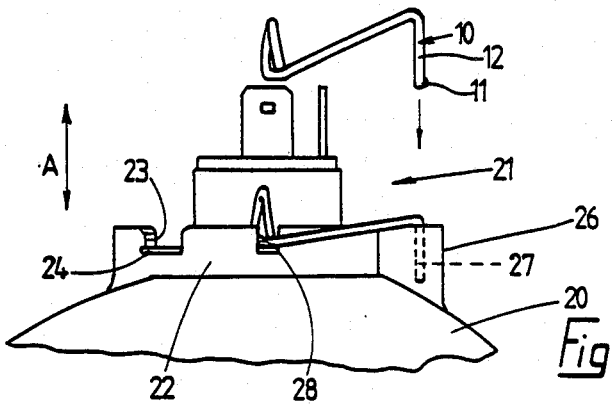
Figure 7:
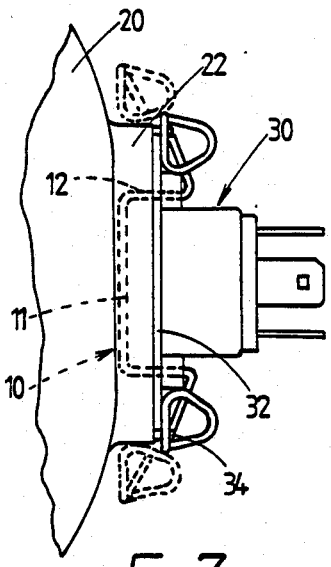
Figure 8:
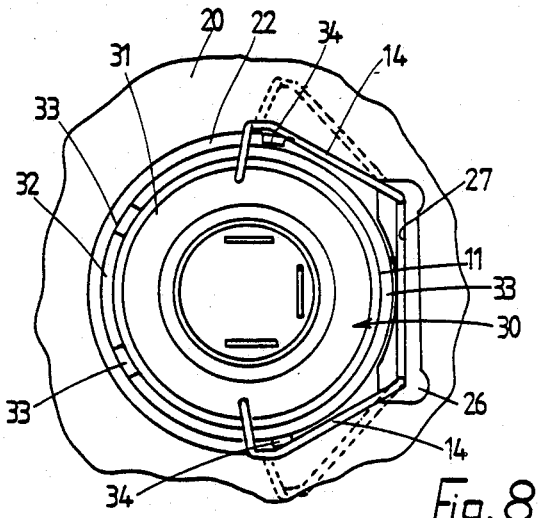
Figure 9:
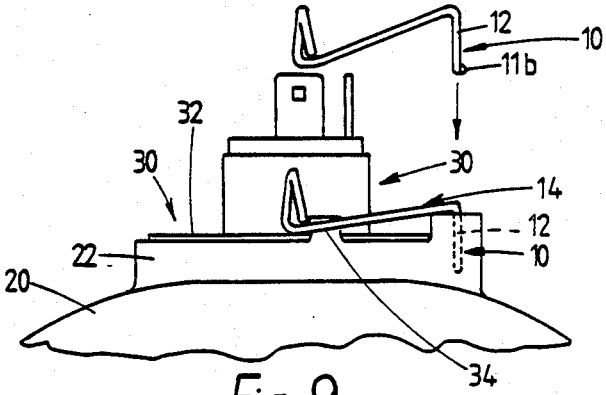
Figure 10:
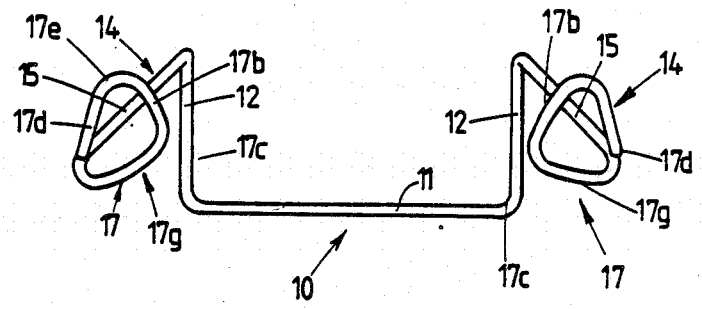
Figure 11:
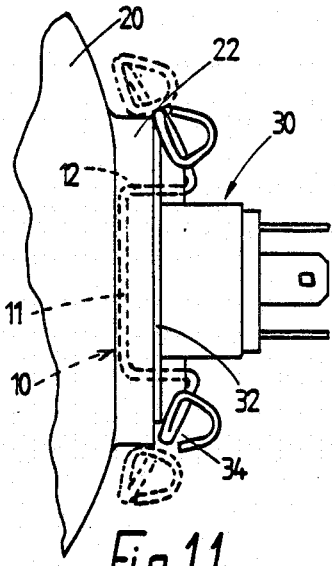
Figure 13:
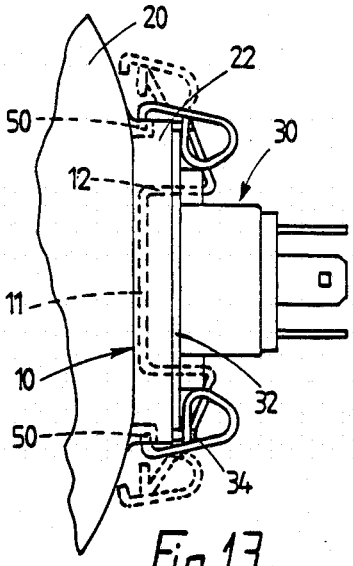
Figure 12:
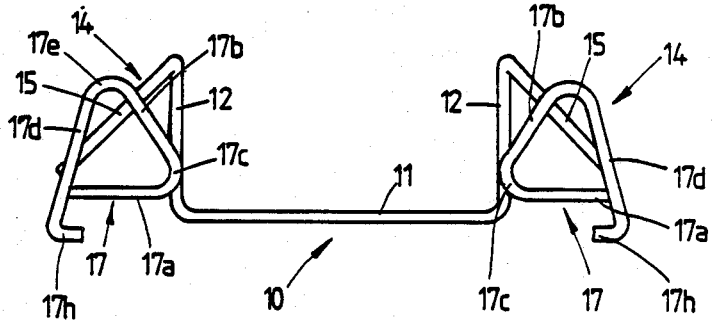

Embodiments of the present invention will now be described, by way of example, with reference to the accompanying drawings, in which:

FIG. 1 is a plan view of one form of retaining device for use in a light assembly according to the present invention, FIG. 2 is a side view of the retaining device of FIG. 1, FIG. 3 is an end view of the retaining device of FIGS. 1 and 2, FIG. 4 is a plan view of a light assembly comprising a reflector body and quartz halogen lamp showing the retaining device of FIGS. 1 to 3 serving to retain the lamp in an opening in the lamp reflector body, FIG. 5 is a side view of the assembly of FIG. 4, FIG. 6 is a side view showing how the retaining device of FIGS. 1 to 3 can be mounted in an ustressed condition in a recess in the lamp reflector body, FIG. 7 is a side view of another light assembly showing how the retaining device can be used to retain a tungsten filament lamp in an opening in a reflector body, FIG. 8 is a plan view of the light assembly of FIG. 7, FIG. 9 is a side view showing the manner in which the retaining device is assembled into the reflector body, FIGS. 10 and 11 are views similar to FIGS. 3 and 7, respectively showing a slightly modified form of the retaining device, and FIGS. 12 and 13 are views similar to FIGS. 3 and 7, respectively, showing another modified form of the retaining device.

Figure 14:
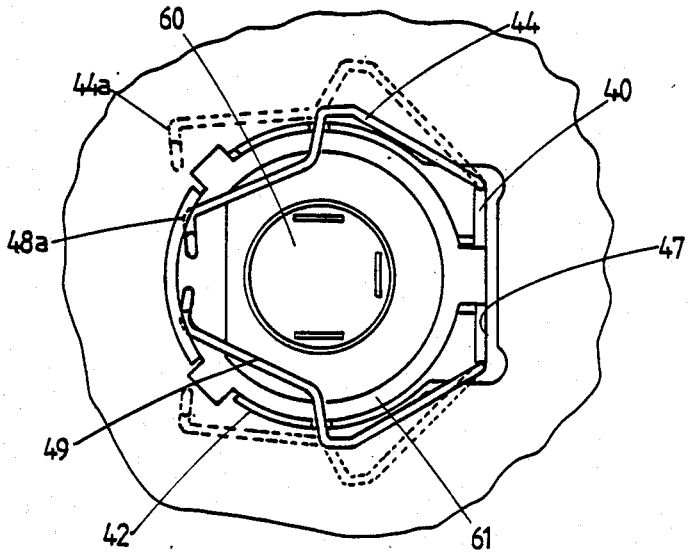
Figure 15:
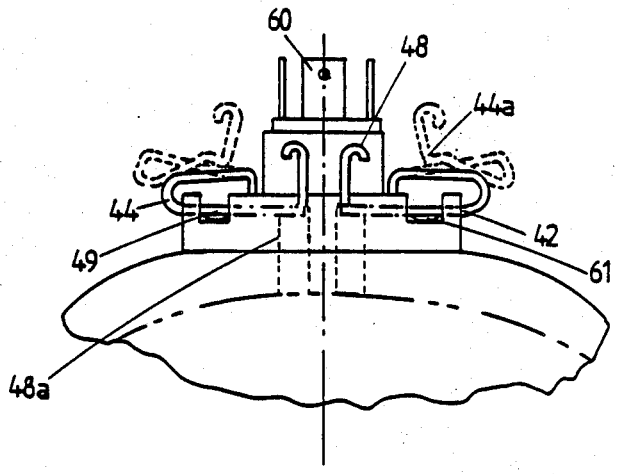

FIGS. 14 and 15 are views similar to FIGS. 4 and 5, respectively showing another modified form of the retaining device.

Referring now to FIGS. 1 to 3, the retaining device illustrated therein is in the form of a spring formed of galvanised steel wire having a diameter of 1.42 mm. The device comprises an anchor portion 10 which is of square U-shaped form (see FIG. 3) with a base 11 which is about twice the length of the arms 12. As can be seen from FIG. 1, the end portions 11*a* of the base 11 are bent slightly upwardly so that the major portion 11*b* of the base is displaced from a plane indicated by dotted line 13 touching the arms 12. If desired, the portions 11*a* can be bent in the opposite direction as is the case with the otherwise identical retaining devices illustrated in FIGS. 4 to 6 and 7 to 9.

The retaining device of FIGS. 1 to 3 further includes a pair of spring arms 14 which are of one piece construction with the anchor portion 10 and which extend from the tops of the respective arms 12 of the anchor portion 10. Each spring arm 14 includes a main arm part 15. The main arm parts 15 are mutually divergent, extending away from the plane 13 at an included angle of 20° as illustrated in FIG. 1 and are also inclined at an acute angle of 25° relative to the respective arms 12 as illustrated in FIG. 2. The main arm parts 15 are straight and join with short arm parts 16 which are inclined with respect to the main arm parts so as to lie mutually parallel as viewed in Fig 1. Each short arm part 16 is joined with an inwardly directed configurated part 17 also forming part of the respective spring arm 14. Each part 17 includes a straight lower part 17*a* joined to an inclined lead-in part 17*b* via an arcuate part 17*c*. The lead-in parts 17*b* are mutually divergent upwardly as viewed in Fig. 4. Each configurated part 17 further includes an outer part 17*d* which is joined with the lead-in part 17*b* through a further arcuate part 17*e*. The lower end of each outer part 17*d* is free and terminates adjacent the junction between the short arm part 16 and the lower part 17*a*. The configurated part 17 is thus of substantially triangular form as viewed in FIG. 3. FIGS. 1 to 3 show the retaining device in an un-stressed condition.

Referring now to FIGS. 4 to 6, there is illustrated a motor vehicle headlight assembly comprising a reflector body 20 moulded from a synthetic plastics material using male and female dies (not shown) whose direction of separation is illustrated by double headed arrow A in FIG. 6, and the retaining device as described above. The retaining device is intended to retain a quartz-halogen lamp 21 in the body 20. The reflector body 20 is, in accordance with usual practice, of dished form and has an internal surface which is rendered reflective. The body 20 is moulded with an external rear sleeve 22 surrounding a lamp-receiving rear aperture in the body 20. The sleeve 22 is provided with recesses 23 in its free end to receive portions 24 of a flange 25 extending from the body of the lamp 21. The lamp 21 is a completely conventional H4 quartz halogen lamp. The rear sleeve 22 has a thickened portion 26 at one side thereof, the thickened portion 26 having a recess 27 in the form of a straight slot therein. As can be seen from FIG. 6, the recess 27 extends into the portion 26 in the direction of separation of the moulding tools and therefore can be readily formed during the moulding process without the requirement for special tooling. The recess 27 has a thickness which is marginally greater than the gauge of the wire used to form the retaining device. The width of the recess 27 is marginally greater than the external width of the U-shaped anchor portion 12. In accordance with normal moulding practice, the walls of the recess 27 taper slightly inwardly to facilitate mould tool withdrawal.

The sleeve 22 is also provided in its free end with a pair of diametrically opposed recesses 28 The bases of the recesses 23 and 28 are coplanar with an annular flange integrally moulded internally of the sleeve 22. The internal flange and the bases of the recesses 23 together form an abutment surface on the reflector body 20.

The manner in which the retaining device is assembled with respect to the reflector body 20 is illustrated in FIG. 6. With the retaining device in its unstressed state (i.e. as shown in FIGS. 1 to 3), the anchor portion 10 is pressed into the recess 27 in which it is a friction fit so that the arms extend therefrom in cantilever fashion. The dimensions of the retaining device and the relationship between the recesses 28 and the recess 27 are such that, before the base portion 11*b* engages the base of the recess 27, the lower parts 17*a* of the spring arms 14 have become engaged against the bases of the respective recesses 28. Further movement of the anchor portion 12 into the recess 27 causes the spring arms 14 to become stressed. The resultant reaction on the anchor portion 12 causes it to tend to distort and lock against the major walls of the recess 27 so that the force required to withdraw the anchor portion 12 from the recess 27 is increased. The arm 14 are so inclined relative to the anchor portion 12 that they adopt the positions shown in full line in FIGS. 4 to 6. In other words, the arms 14 project through the recesses 28 and into the sleeve 22. In so doing, they bear against the upper surface of the flange 25 of the lamp 21 so as to urge the undersides of the flanges 24 against the bases of the recesses 23 and against the annular flange internally of the sleeve 22. This holds the lamp 21 and therefore the filament thereof in the correct position relative to the reflector body 20. It will be appreciated from the above that the arms 14 are resiliently biassed in the same direction as that in which the flange 25 of the lamp 21 has to be moved to cause the flanges 24 to engage against the bases of the recesses 23 and the annular flange internally of the sleeve 22.

Initial assembly of the lamp 21 into the reflector body 20 can be effected with the retaining device 10 in either one of two positions which can be selected as desired for convenience of assembly.

In one method of the assembly, the retaining device 10 is left in the position shown in full line in FIGS. 4 and 5. During assembly of the lamp 21, it is inserted, lamp envelope foremost, into the sleeve 22 with the flanges 24 aligned with the recesses 23 until the flange 25 engages against the configurated part 17. Further movement of the lamp 21 into the sleeve 22 causes diametrically opposite edges of the flange 25 to move over the lead-in parts 17*b* by urging the arms 14 radially outwardly against their inherent spring biassing. During assembly of the lamp 21 into the reflector body 20, the lower parts 17*a* of the arms 14 remain engaged with the bases of the respective recesses 28 until the lamp 21 is fully assembled into the reflector body 20 with the flange portions 24 abutting against the recesses 23. At which time, the arms 14 snap back into the inward positions shown in full line in FIGS. 4 and 5 to retain the lamp 21 in position. Such inward movement of the arm portions 14 over the edge of the flange 25 is facilitated because of the arcuate shape of the parts 17*c* of the retaining device 10. During this method of assembly, in the outerwardly biassed position of the arms 14, the inner end portions of the straight lower parts 17*a* rest on the bases of the recesses 28. In the lamp-retaining condition as illustrated in full line in FIG. 4, the inward biassing of the arms 14 is limited by engagement of the main arm parts 15 against the external surface of the sleeve 22. However, it is within the scope of the present invention for the construction to be such that the external surface of the sleeve 22 does not act as a stop and that the inward position of the arms 14 is determined merely by the balance between the frictional force of the arms 14 on the upper surface of the flange 25 and the inward biassing force of the arms 14.

In the other method of assembly, and for lamp replacement purposes in service, the arms 14 can be manually moved into the positions shown in dotted line in FIGS. 4 and 5 where the configurated parts 17 lie completely outwardly of the sleeve 22. In this position, the inherent biassing of the arms 14 causes them to move downwardly as viewed in FIG. 4 (or to the left as viewed in FIG. 5) so that the arcuate parts 17*c* abut against the external surface of the sleeve 22 and are thus prevented from moving inwardly. In this condition, the configurated parts 17 lie completely externally of the sleeve 22 so that the lamp 21 can be assembled, unhindered, into the reflector body 20 or can be removed therefrom. Once the lamp 21 has been assembled into the body 20, the arms 14 are manually moved upwardly as viewed in FIG. 4 (or to the right as viewed in FIG. 5) against the inherent biassing thereof until the configurated parts 17 have moved beyond the flange 25 of the lamp 21. Thereupon, the inherent inward biassing of the arms 14 causes them to move inwardly to adopt the position shown in full line in FIGS. 4 and 5 to hold the lamp 21 in position.

Referring now to FIGS. 7 to 9 of the drawings, the assembly illustrated therein is similar to that of FIGS. 4 to 6 and similar parts are accorded the same reference numerals. In this embodiment, the headlamp assembly includes a conventional tungsten filament lamp 30 provided with a cup-shaped flange 31 having an outwardly directed lip 32 having bearing regions 33 (see FIG. 8) which rest upon the free end surface of the sleeve 22. In this embodiment, the sleeve 22 is somewhat shorter than the sleeve 22 of the embodiment of FIGS. 4 to 6. Inward biassing of arms 14 in the lamp retaining position is limited by posts 34 which are moulded integrally with the sleeve 22 so as to extend away from the free end thereof.

The retaining device of FIGS. 7 to 9 operates in the same way as that described above with reference to FIGS. 4 to 6.

In order to provide a further safeguard against accidental disengagement of the retaining device from the reflector body, the latter is preferably subjected to lacquer coating after assembly of the retaining device. During lacquer coating, some of the lacquer enters the recess in which the anchor portion of the device is lodged and thereby provides a further means for retention of the anchor portion in the recess.

With the above-described retaining device, there is the risk that, if an attempt is made to withdraw the bulb 21 forcibly from the lamp assembly, the arms 14 will become permanently deformed because the straight lower parts 17*a* of the configurated parts 17 lie perpendicular to the withdrawal direction. The modifications of FIGS. 10 and 11 and FIG. 12 and 13 are intended to mitigate this problem. In the modification of FIGS. 10 and 11, the straight lower part 17*a* of each configurated part 17 is replaced by an inclined part 17*g* which is inclined upwardly and inwardly so that forcible withdrawal of the lamp 21 causes the arm 14 to be urged radially outwardly against its inherent biassing until the whole of the configurated part 17 lies outwardly of the lamp 21 which is then free to be removed. Such outward biassing movement of the arms 14 does not occur beyond their elastic limit. Preferably the inclines 17*b* and 17*g* are arranged such that it is easier to introduce the lamp through the retaining clip than it is to remove it.

In the modification of FIGS. 12 and 13, the straight lower portion 17*a* of each configurated part 17 is retained but the lower end of each outer part 17*d* is extended downwardly (see FIG. 12) and its extreme end portion 17*h* is turned inwardly to define an inwardly directed pin which automatically engages in a respective recess 50 (see FIG. 13) provided in the outer peripheral surface of the sleeve 22. In this modification, engagement of the pins in the recesses 50 provides a positive interlocking engagement which resists all withdrawal forces which are likely to be encountered in practice. However, withdrawal of the lamp 21 for replacement purposes is permitted once the arms 14 have been flexed outwardly manually and adopt the position illustrated in dotted line in FIG. 13.

In a further modification of FIGS. 14 and 15, the pair of spring arms 44 of one piece construction with the anchor portion 40 are arranged in cantiliver fashion to extend, when the anchor portion 40 is assembled into the recess 47 in the sleeve 42 when not in use, away from the bore in the sleeve 42, so that a lamp can be assembled into the sleeve without being impeded by the retaining device. It will be appreciated that the free ends of the spring arms 44 need now not be arranged to provide inclined surfaces to assist the lamp in causing them to move away from each other as the lamp is assembled, as in the previous examples. However, the free ends of the arms are arranged in simple fashion 48 to assist bringing the spring arms 44 together after the lamp has been assembled into the reflector. The arms 44 are not only biassed in a direction away from the sleeve 42 but also in a direction at right angles to this so that the arms when moved towards each other will pass over the free end of the sleeve 42 to lie, while held in this position, above the flange 61 of the lamp 60. The arms 44 are then moved in the first direction towards the sleeve 42. Releasing the ends 47 causes protuberances 44*a* on the arms 44 to move into the undercut portions 48*a* in the bore of the sleeve 42, while causing shaped areas 49 on the arms 44 to be resiliently biassed in the direction against the lamp to urge resiliently the abutment surfaces of the body and the lamp into mutual engagement.

While in this example the shaped areas 49 have been separate to the protuberances 44*a*, it would be possible to have single shapings of the arms 44 which move into respective undercuts which taper so as to cause the arms to move the lamp and the body relatively together as the arms move outwards into the undercuts.

Due to the predictable positioning of the retaining clip once assembled into the body, and the design of the clips of the examples of the invention, it will be appreciated that the initial assembly of the lamp and body into locking engagement can easily be achieved by automated production in both a simple and convenient manner. It will also be appreciated, that removal of the lamp and its reassembly manually is also made simple by the design of the invention.

I claim

1. A light assembly comprising a dished reflector body having an axis formed by a moulding operation with a lamp-receiving aperture, a formation adjacent said lamp receiving aperture and a rearward facing abutment surface; and a retaining device for urging a forward-facing abutment surface on a lamp in a first direction against said rearward-facing abutment surface on said body, said retaining device including a resilient element having an anchor portion secured to said formation on said body to be non-pivotal about an axis transverse to said reflector and said anchor portion defining a projection for engagement in a recess in said body with said recess extending in a first direction in said body parallel to the body axis, and at least one arm extending in cantilever fashion from said anchor portion, said arm being disposed so as to urge the forward-facing abutment surface on the lamp and the rearward-facing a butment surface on the body into mutual engagement, wherein said formation extends in the direction of draw of said body from a mould used for the formation of said body.

2. A light assembly as claimed in claim 1 wherein said lamp-receiving aperture is defined by a sleeve extending in said first direction from said body, and said at least one arm portion extends in use from said anchor portion over a free end of said sleeve within said aperture.

3. A light assembly as claimed in claim 1, wherein the arrangement is such that bearing of at least one arm portion against the lamp in use causes said anchor portion to be deformed, thereby to increase the force required to disengage the anchor portion from the body, th anchor portion being engageable with said body when said at least one arm portion is not in a stressed condition.

4. A light assembly as claimed in claim 1, wherein said resilient element is in the form of a wire clip.

5. An assembly as claimed in claim 1, wherein said anchor portion takes the form of a substantially U-shaped portion and said recess has a width and thickness which corresponds to the width and thickness of said U-shaped portion.

6. An assembly as claimed in claim 21, wherein said resilient element has a pair of spaced arms extending from said anchor portion.

7. An assembly as claimed in claim 1, wherein said at least one arm portion is resiliently biassed into engagement with said first abutment surface when the lamp is not assembled in the body.

8. An assembly as claimed in claim 1, wherein lacquer is provided on the reflector body over the anchor portion so as to assist in preventing disengagement of the retaining device from the body.

9. An assembly as claimed in claim 1, wherein said at least one arm portion is also resiliently deformable in a second direction which is substantially perpendicular to said first direction, to a position in which it lies clear of said lamp.

10. An assembly as claimed in claim 1, wherein interengaging formations are provided on said at least one arm portion and said body to resist deformation of said at least one arm portion.

11. A light assembly comprising a dished reflector body; a sleeve extending rearwardly from said body, said sleeve defining a lamp-receiving bore which extends from an inner surface of said body to a rearward end of said sleeve; a rearward-facing abutment surface on said sleeve; means defining at least one undercut in said lamp-receiving bore, said undercut extending from said inner surface of said body to a location rearwardly of said rearward-facing abutment surface; and a retaining device for urging a forward-facing abutment surface on a lamp into engagement with said rearward-facing abutment surface, said retaining device including a resilient element having an anchor portion non-pivotally secured to said body and at least one arm extending in cantilever fashion from said anchor portion, said arm being biassed so as to be disposed away from the bore to allow assembly of the lamp into said bore but being movable inwardly of said sleeve and forwardly with respect to said body to a position in which a portion of said arm engages said undercut to retain said arm releasably in a position in which in use, the forward-facing abutment surface on the lamp is urged into engagement with said rearward-facing abutment surface on said sleeve.

12. A light assembly as claimed in claim 11, wherein said anchor portion is engaged in a recess in said body, said recess extending substantially axially of said body and opening rearwardly of said body on the opposite side of said lamp-receiving bore to said means defining at least one undercut.

* * * * *